US010369817B2

(12) United States Patent
Wierda et al.

(10) Patent No.: US 10,369,817 B2
(45) Date of Patent: Aug. 6, 2019

(54) PRINTER WITH MEDIA STORAGE DEVICE

(71) Applicant: Océ Holding B.V., Venlo (NL)

(72) Inventors: Klaas Jan Wierda, Venlo (NL); Andreas Wierda, Venlo (NL); Lambertus A. H. Van Vonderen, Venlo (NL); Hugouw T. Schenk, Venlo (NL); Norbert J. M. Janssen, Venlo (NL); Roelof Hamberg, Venlo (NL); Christianus J. M. G. Van Rijt, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 29 days.

(21) Appl. No.: 15/813,988

(22) Filed: Nov. 15, 2017

(65) Prior Publication Data

US 2018/0147863 A1 May 31, 2018

(30) Foreign Application Priority Data

Nov. 30, 2016 (EP) ..... 16201344

(51) Int. Cl.

| | |
|---|---|
| ***B41J 3/54*** | (2006.01) |
| ***B41J 3/46*** | (2006.01) |
| ***B41J 13/00*** | (2006.01) |
| ***B41J 29/54*** | (2006.01) |
| ***B41J 11/00*** | (2006.01) |
| ***G03G 15/00*** | (2006.01) |
| ***B41J 13/10*** | (2006.01) |

(Continued)

(52) U.S. Cl.

CPC ..... *B41J 13/0027* (2013.01); *B41J 3/46* (2013.01); *B41J 3/54* (2013.01); *B41J 11/009* (2013.01); *B41J 13/0036* (2013.01); *B41J 13/103* (2013.01); *B41J 29/54* (2013.01); *G03G 15/5029* (2013.01); *B41J 2/01* (2013.01); *B41J 13/08* (2013.01); *G03G 2215/00729* (2013.01); *G03G 2215/00797* (2013.01)

(58) Field of Classification Search

CPC ..... B41J 13/0027; B41J 3/46; B41J 13/103; B41J 3/54; B41J 11/009; B41J 13/0036; B41J 29/54; B41J 13/08; B41J 2/01; G03G 15/5029; G03G 2215/00797; G03G 2215/00729

See application file for complete search history.

(56) References Cited

U.S. PATENT DOCUMENTS

| | | | |
|---|---|---|---|
| 5,053,814 | A | 10/1991 | Takano et al. |
| 5,177,544 | A | 1/1993 | Kimura et al. |
| 5,373,350 | A | 12/1994 | Taylor et al. |

(Continued)

OTHER PUBLICATIONS

European Search Report of application EP 16 20 1344, dated May 18, 2017.

*Primary Examiner* — Scott A Richmond

(74) *Attorney, Agent, or Firm* — Birch, Stewart, Kolasch & Birch, LLP

(57) ABSTRACT

A printer includes a media storage device, a print engine and a media supply system for supplying print media from the media storage device to the print engine. The printer is arranged to print media-related information onto media that are left over in the media storage device after a print process. The media storage device includes a tray arranged for accommodating cut media sheets and having an auxiliary printer for printing the media-related information onto a sheet in the tray.

4 Claims, 3 Drawing Sheets

(51) Int. Cl.
*B41J 13/08* (2006.01)
*B41J 2/01* (2006.01)

(56) References Cited

U.S. PATENT DOCUMENTS

| | | | | |
|---|---|---|---|---|
| 6,210,052 | B1 | 4/2001 | Smith | |
| 6,985,682 | B2 | 1/2006 | Haines et al. | |
| 2003/0095810 | A1* | 5/2003 | Haines | G03G 15/5029 399/84 |
| 2009/0027474 | A1* | 1/2009 | Silverbrook | B41J 2/155 347/104 |
| 2014/0192127 | A1* | 7/2014 | Arima | B41J 29/36 347/179 |
| 2015/0286447 | A1 | 10/2015 | Thijssen et al. | |

* cited by examiner

PRINTER WITH MEDIA STORAGE DEVICE

FIELD OF THE INVENTION

The present invention relates to a printer comprising a media storage device, a print engine and a media supply system for supplying print media from the media storage device to the print engine, the printer being arranged to print media-related information onto media that are left over in the media storage device after a print process.

BACKGROUND OF THE INVENTION

U.S. Pat. No. 6,210,052 B1 describes a printer of this type, wherein the media storage device takes the form of a roll from which the media are supplied to the print engine in the form of an endless web which is cut into separate sheets only at the time of printing. When a number of prints has been made, the print engine is used for printing the media-related information, which identifies the type of media, onto the leading end of the web which is then re-wound on the roll. When the same media type is to be used again in a later print process, the web is supplied again to the print engine, and a reading head reads the media-related information from the web so that the settings of the printer may automatically be adapted to the media type as identified on the web. When the roll is removed from the printer, an operator may read the media-related information in order to decide to which storage place the roll should be transferred.

U.S. Pat. No. 6,985,682 B2 and US 2015/286447 A1 disclose cut-sheet printers in which the print engine is used for printing the media-related information onto a sheet that is then discharged at an output bin of the printer. When left over media sheets remain in the storage device on the input side of the printer and are to be taken out of the printer, the sheet with the media-related information is manually transferred to the stack of sheets taken out of the printer on the input side in order to identify the media type.

It is an object of the present invention to provide a cut-sheet printer in which left over media sheets can be identified more reliably and more conveniently.

SUMMARY OF THE INVENTION

In order to achieve this object, in the printer according to the present invention, the media storage device comprises a tray arranged for accommodating cut media sheets and having an auxiliary printer for printing the media-related information onto the sheet in the tray.

In comparison to known cut-sheet printers, this eliminates the need to transfer a sheet with the media-related information manually from the discharge side to the input side of the printer, because the auxiliary printer is used for printing this information "in situ", i.e. the auxiliary printer is arranged to print on to a sheet in the tray and the sheet does not have to be removed from the tray. This is not only more convenient for the operator but also avoids the risk of errors in assigning the sheet with the media-related information to the media tray that accommodates or has accommodated the left over sheets.

More specific optional features of the present invention are indicated in the dependent claims.

The auxiliary printer may be a low-cost printer, e.g. an ink jet printer installed in or above the tray in such a position that it can print the media-related information directly on the top sheet on the stack of left over sheets.

The process of printing the media-related information may be triggered by a pre-defined event which indicates that a print job has ended and left over sheets may or will be removed from the tray. For example, the triggering event may be an action in which the tray is opened or it is at least attempted to open the tray.

Optionally, the triggering event may at first trigger a dialogue in which the user or operator is asked whether he wants to have the media-related information printed out. Thus, the printing of this information may be inhibited in certain cases, for example, when no sheets are left over in the tray or when the user opens the tray in order to refill it with new media sheets of the same type.

BRIEF DESCRIPTION OF THE DRAWINGS

The present invention will now be described in more detail using examples in conjunction with drawings wherein the same elements are identified with the same reference numeral and wherein.

DETAILED DESCRIPTION OF EMBODIMENTS

Figure 1:
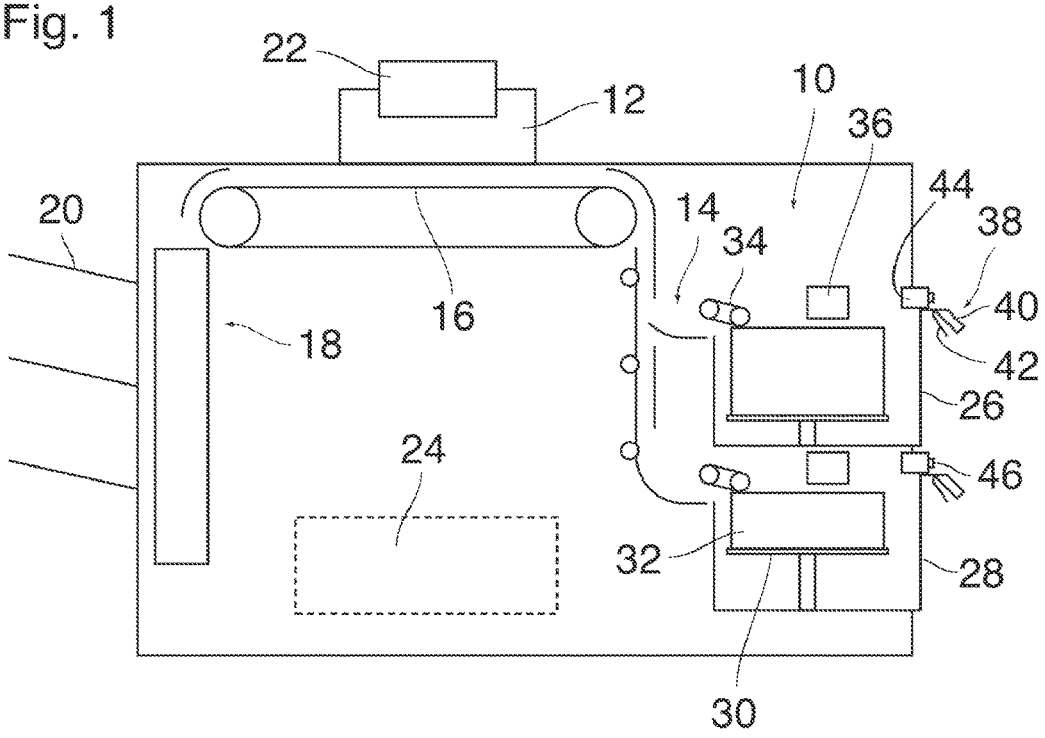
FIG. 1 is a schematic view of a printer according to the present invention.

In an example (FIG. 1), a printer embodying the principles of the present invention comprises a media storage device 10 for cut media sheets, a print engine 12 and a media supply system 14 arranged for supplying media sheets from the storage device 10 to the print engine 12. A conveyer 16 is provided for conveying the media sheets supplied from the media supply system 14 past the print engine 12 so that an image may be printed onto each media sheet. A sheet discharge system 18 is arranged for discharging the sheets on which an image has been printed to a selected one of a number of discharge bins 20. An operating panel 22 and an electronic controller 24 are provided for controlling the operations of the printer.

In the example, the media storage device 10 comprises two drawers 26, 28 which have an essentially identical construction and each accommodate a liftable tray 30 supporting a stack 32 of media sheets. For each of the trays 30, a pivotable feed roller assembly 34 is provided for engaging the top sheet on the stack 32 and feeding it into the sheet supply system 14 upon demand.

Further, an auxiliary printer 36, e.g. an ink jet printer, is provided for each of the trays 30. Each auxiliary printer 36 is mounted in a fixed position in a frame of the (main) printer and has a print head (not shown in detail) facing the top sheet on the stack 32.

Each drawer 26, 28 has a handle 38 with a display 40 and a manually operable switch 42 integrated therein. A lock 44 is provided for locking and unlocking the drawer.

The drawers 26 and 28 may accommodate media sheets of different types. When a print job has been transmitted from a remote location via a network or has been entered locally at the operating panel 22, the job specifications will indicate the media type that shall be used for printing. The controller 24 will select out of the trays 30 a tray 30 that accommodates the desired media type. When the print job has started, the media sheets will be withdrawn one by one from the top of the stack 32 and will be supplied past the print engine 12, and the printed copies will be discharged on one of the discharge bins 20. As the height of the stack 32 decreases in the course of the print job, the tray 30 will automatically be lifted so as to hold the top sheet on the stack in engagement with the feed roller assembly 34.

In a typical scenario of using the printer of the example, a smaller stack of media sheets will remain on the tray 30 when the print job is finished. Then, in case that another media type is required for a subsequent print job, and this media type is not available in the other one of the two drawers 26, 28, it is necessary to remove the left over sheets from the tray so that a new stack of media sheets of the required type may be loaded. The left over sheets that have been removed from the tray 30 have to be kept somewhere, preferably at a place where the media sheets can easily be retrieved when this media type is needed again. It is therefore desirable that media-related information specifying the media type and other relevant information is suitably attached to the stack of left over media sheets. To this end, the controller 24 controls the auxiliary printer 36 to print the media-related information onto the top sheet on the stack of left over sheets before the stack is removed from the tray 30. In this way, when the stack is removed, the media type can easily be identified so that it is possible to transfer the sheets to a suitable storage location.

Figure 2:
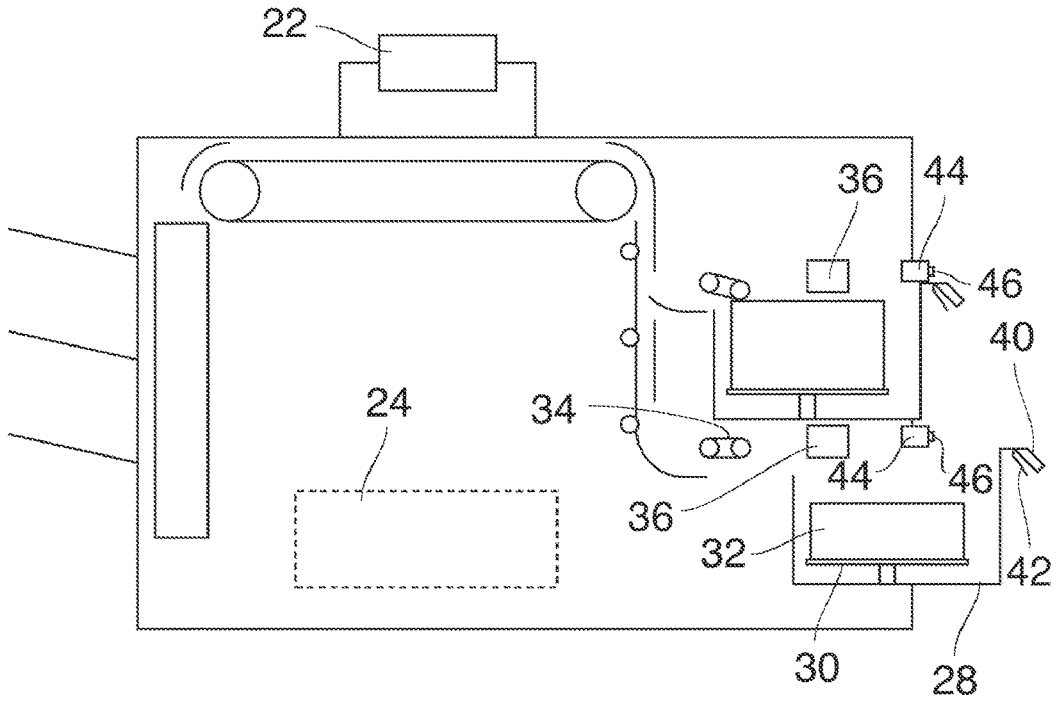
FIG. 2 shows the printer in a different condition.

The auxiliary printer 36 is triggered whenever the tray 30, or rather the drawer 26 or 28 accommodating the same, is opened. For example, when a user grips the handle 38 for opening the drawer, he will operate the switch 42, which causes the auxiliary printer 36 to start printing while the lock 44 keeps the drawer locked. When the auxiliary printer 36 has finished printing, the feed roller assembly 34 is tilted into a position (shown in FIG. 2 for the lower drawer 28) where it is disengaged from the topmost sheet on the stack, and the tray 30 will automatically be lowered into a position where the top of the stack 32 is safely cleared from them auxiliary printer 36. Only then will the lock 44 release the drawer so that it may be drawn open, as has also been shown for the drawer 28 in FIG. 2. When the drawer is fully drawn out, the stack 32 of left over sheets may easily and safely be removed, and the topmost sheet of the stack will carry the information that is needed for appropriately storing the removed sheets.

There however are scenarios where it is not appropriate to activate the auxiliary printer 36 when the drawer is opened. An example would be the case that the stack on the tray 30 has been depleted completely, so that there is no sheet left for printing on. In such a case, the auxiliary printer 36 is be inhibited from printing automatically by the controller 24.

Another scenario is that the user opens the drawer for topping up the supply of media sheets of the same type on the stack 32. A typical situation of this type would be that the controller 24 recognizes that the number of sheets remaining on the stack 32 is not sufficient for completing a running print job, and therefore the user is prompted by a message displayed on the operating panel 22 to top up the supply of media sheets. In such a case, the auxiliary printer 36 is inhibited from printing automatically by the controller 24.

In the example, operation of the switch 42 does not automatically trigger the auxiliary printer 36, but instead it triggers the display 40 on the handle 38 for showing a dialogue asking the user or operator whether or not he wants to have printed the media-related information. When the user wants to have the information printed, he will confirm this by pressing a button 46 on the lock 44, which triggers the sequence of operating the auxiliary printer 36, lifting the feed roller assembly 34, lowering the tray 30 and unlocking the drawer. If the user does not press the button 46 but instead operates the switch 42 once again, this will trigger the sequence of lifting the feed roller assembly 34, lowering the tray 30 and unlocking the drawer, without activating the auxiliary printer 36.

Figure 3:
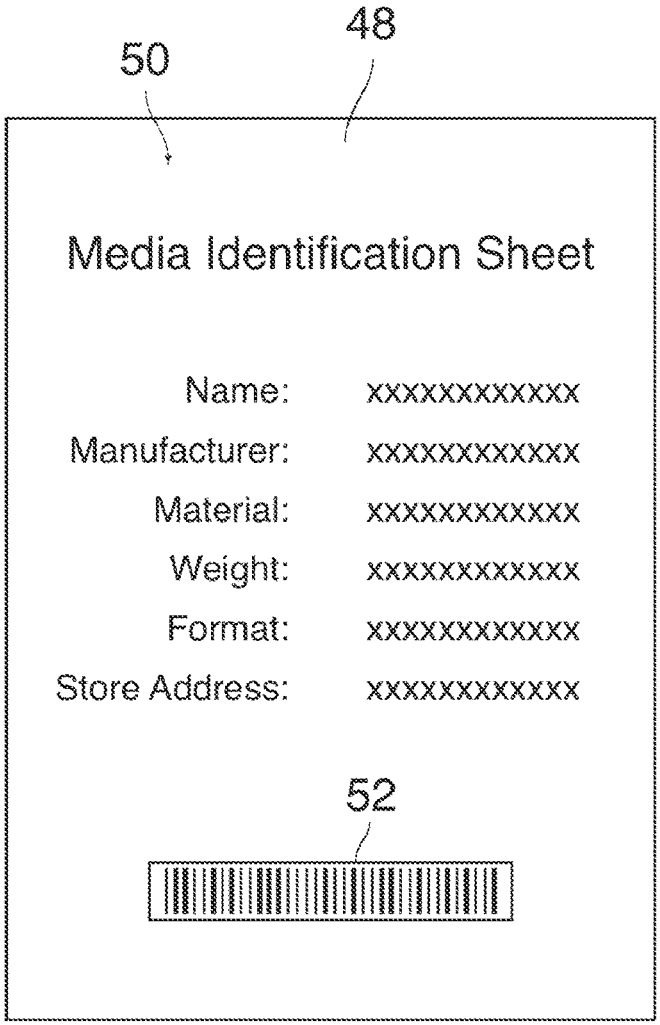
FIG. 3 is an example of a sheet with media-related information printed thereon.

FIG. 3 shows an example of a media sheet 48 on which media-related information 50 has been printed by means of the auxiliary printer 36. In this example, the media-related information comprises a name and a manufacturer of the media, the material, weight and format of the media as well as a storage address under which the media sheets are to be stored for further use. The same information is also encoded in a machine-readable token 52 such as a bar code. Optionally, each auxiliary printer 36 may be combined with a reader capable of reading the tokens 52, so that the media-related information may be read automatically and stored in the controller 42 when the media sheets are reloaded into one of the drawers 26, 28. Of course, the sheet 48 carrying this information will then be removed automatically by conveying it to one of the discharge bins 20 without activating the print engine 12.

Figure 4:
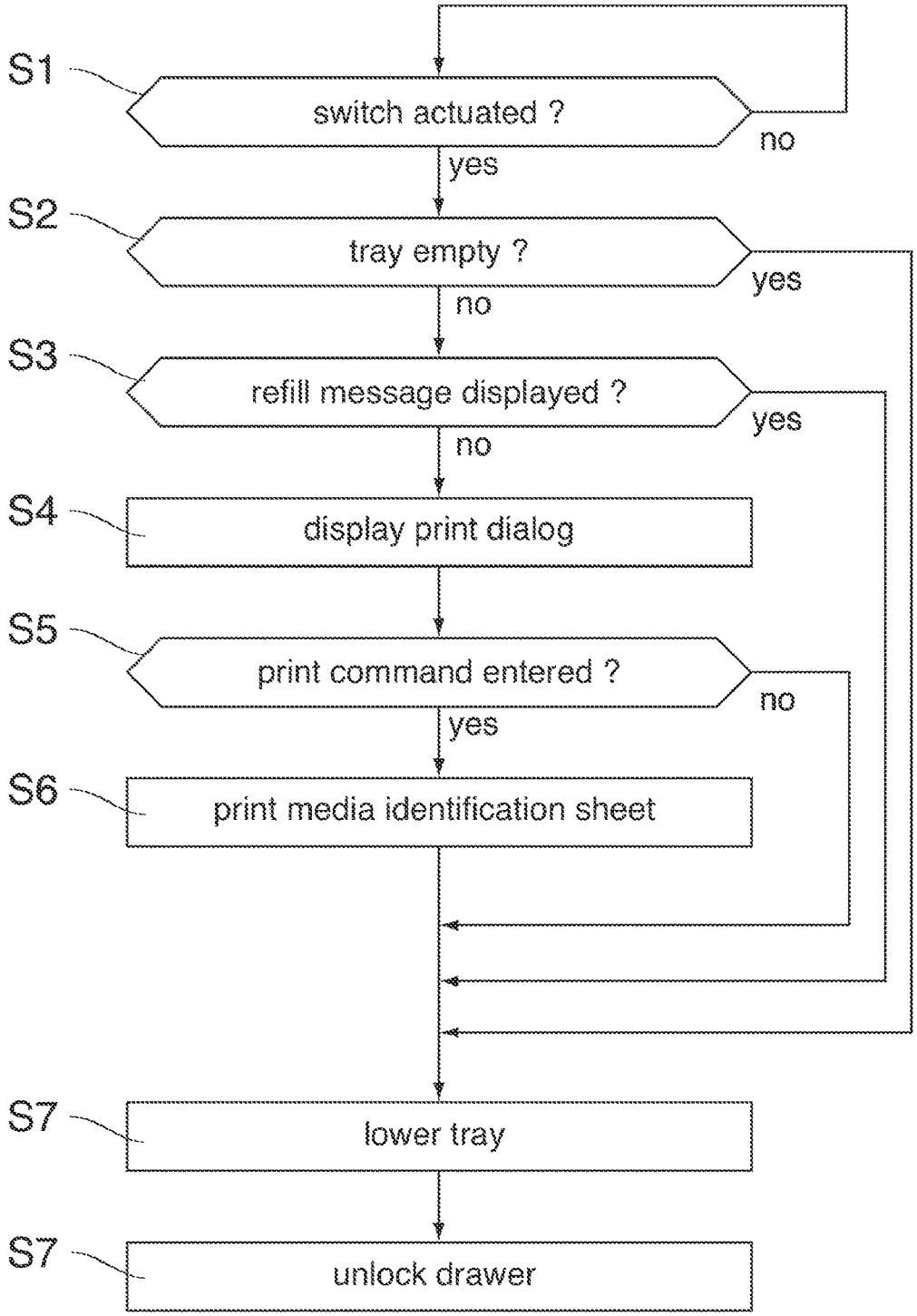
FIG. 4 is a flow diagram illustrating a routine for deciding whether or not media-related information shall be printed.

FIG. 4 is a flow diagram illustrating an algorithm that is implemented in the controller 24 for deciding whether or not the auxiliary printer 36 shall be activated.

In step S1 it is checked whether the switch 42 has been activated. As long as this is not the case, the step S1 is repeated cyclically, until a positive result (yes) is obtained. Then it is checked in step S2 whether the related tray 30 is empty. If this is not the case (no), it is checked in step S3 whether a refill message prompting the user to top up the supply of media sheets on the stack 32 with further sheets of the same type has been displayed on the operating panel 22. If this is not the case (no), a dialogue is shown on the display 40, whereby the user is invited to indicate whether or not he wants to have printed the media-related information.

Then, in step S5, it is checked whether the user has confirmed that the media-related information shall be printed, e.g. by pressing the button 46. If the button has been pressed (yes), the media-related information is printed on the topmost sheet on the stack 32 in step S6. Subsequently the tray 30 is lowered in step S7, and the pertinent drawer 26 or 28 is unlocked in step S8.

When it was found in step S2 that the tray 30 is empty (yes), the steps S3-S6 are skipped. Similarly, the steps S4-S6 are skipped when it is found in step S3 that a refill message had been displayed, and the step S6 is skipped when it is found in step S5 that the user has not entered a print command.

The present invention being thus described, it will be obvious to the skilled person that variations of the implementation of the present invention are possible. In a variant of the example above, the auxiliary printer 34 is integrated in each of the trays 30. In such an example, the auxiliary printer 36 would not print on the top sheet but on a sheet 48 in contact with the tray 30.

The invention claimed is:

1. A printer comprising a media storage device, a print engine and a media supply system for supplying print media from the media storage device to the print engine, the printer being arranged to print media-related information onto media that are left over in the media storage device after a print process, the media storage device comprising a tray arranged for accommodating cut media sheets and having an auxiliary printer for printing the media-related information onto a sheet in the tray, wherein the printer comprises a controller configured to detect a command for opening a tray and upon detecting such a command the controller activates the auxiliary printer and the controller is configured to detect whether or not the tray is empty and upon detection of an empty tray the controller inhibits the auxiliary printer from printing.

2. The printer according to claim 1, wherein the controller is configured to output a message inviting a user to top up a supply of media sheets on the tray at a time before the tray is empty, and the controller is further configured to inhibit the auxiliary printer from printing when such a message has been output.

3. The printer according to claim 1, wherein the controller is configured to present, when detecting a command for opening the tray, a dialogue on a display, the dialogue inviting a user to indicate whether or not he wants to have printed the media-related information.

4. The printer according to claim 1, wherein the tray is arranged to accommodate a stack of media sheets, and the auxiliary printer is arranged for printing the media-related information onto a topmost sheet on the stack.

* * * * *